US005402553A

United States Patent [19]

Goetz et al.

[11] Patent Number: 5,402,553

[45] Date of Patent: Apr. 4, 1995

[54] REFRIGERATOR DOOR HANDLE AND METHOD OF ATTACHING

[75] Inventors: Glenn E. Goetz, Amana; Brian D. Towle, Cedar Rapids; Larry D. Yoder, Marengo, all of Iowa

[73] Assignee: Amana Refrigeration Inc., Amana, Iowa

[21] Appl. No.: 91,547

[22] Filed: Jul. 14, 1993

[51] Int. Cl.[6] ..... E05B 1/00

[52] U.S. Cl. ..... 16/114 R

[58] Field of Search ..... 16/114 R, 110 R; 312/405, 244

[56] References Cited

U.S. PATENT DOCUMENTS

| | | | |
|---|---|---|---|
| 3,078,524 | 2/1963 | Minick . | |
| 3,509,592 | 5/1970 | Schrock | 16/110 R |
| 3,514,904 | 6/1970 | Riegelman | 16/114 R |
| 4,033,010 | 7/1977 | McCalla | 16/114 R |
| 4,922,576 | 5/1990 | Weidner et al. | 16/114 R |

FOREIGN PATENT DOCUMENTS

| | | | |
|---|---|---|---|
| 0635992 | 5/1983 | Switzerland | 16/114 R |

*Primary Examiner*—P. Austin Bradley
*Assistant Examiner*—Chuck Y. Mah
*Attorney, Agent, or Firm*—William R. Clark

[57] ABSTRACT

A refrigerator door handle and a method of attaching the handle to a door panel. A door handle retainer strip includes an elongated channel having a shoulder opposite a laterally extending longitudinal groove. After the retainer strip is screwed to the door panel, a rail on the back of the handle is inserted into the channel. The rail has a laterally extending tongue that is received in sliding engagement in the groove as the handle is moved laterally. The handle is then secured or locked in that position within the channel of the retainer strip by driving screws between the shoulder and the rail at the ends of the handle.

14 Claims, 4 Drawing Sheets

REFRIGERATOR DOOR HANDLE AND METHOD OF ATTACHING

BACKGROUND OF THE INVENTION

The field of the invention generally relates to door handles, and more particularly relates to refrigerator door handles and a method of attaching such handles.

As is well known, refrigerator door handles are commonly made using a conventional extrusion process wherein a material such as aluminum is extruded through a die having a particular cross-sectional shape. The use of extruded door handles has particular advantage when manufacturing refrigerators where product differentiation is important. That is, extruded handles may be advantageous when it is desirable to have different models or brands of refrigerators look differently in a showroom. For example, one beneficial application for extruded handles is for refrigerators built by one manufacturer and sold under another company's name. One important reason for using extruded handles is that it is relatively inexpensive to extrude relatively low quantities of door handles with a variety of different shapes to vary the appearance of refrigerators that are the same or essentially the same.

Typically, a refrigerator door handle is a unitary part having a mounting portion and a grip portion. The mounting portion generally has a flat region that is positioned flush against the face or edge of the refrigerator door. Screws or other suitable fasteners are then used to secure the door handle to the refrigerator door. The screw heads are normally covered by attaching a trim strip. The grip portion is generally offset or spaced from the door so that it can easily be grasped for opening. Because the area where the screws are driven should be inconspicuous but at the same time accessible to a screw driver, there are limitations on the shape or configuration of grip portions that are used. For example, if the grip portion were to extend out and completely cover the mounting portion, it would be inconvenient or impossible to get a screw driver into position to drive screws through the mounting portion. Therefore, door handles of this particular shape and others have not been used because of mounting limitations.

SUMMARY OF THE INVENTION

In accordance with the invention, a combination of elements includes a door, a door handle retainer attached to the door, and a door handle wherein the door handle and door handle retainer comprise respective means responsive to relative lateral motion of the door handle to the door handle retainer for engaging the door handle to the door handle retainer. The combination further includes stop means for preventing relative lateral motion of the door handle once engaged to the door handle retainer to lock the door handle to the door handle retainer. Preferably, the engaging means comprises a tongue on the door handle and a mating groove in the door handle retainer. Also, the engaging means may further comprise a second tongue on the door handle and a second mating groove in the door handle retainer. In a preferred embodiment, the door handle retainer comprises a channel having a shoulder opposite a laterally extending groove, and the door handle comprises a rearwardly projecting rail with a laterally projecting tongue adapted for sliding engagement into the groove of the door handle retainer. Also, the stop means may comprise a screw driven into a gap between the shoulder and the rail once the door handle is engaged to the door handle retainer.

The invention may also be practiced by a method of fabricating a refrigerator door comprising the steps of extruding a door handle having a rearwardly projecting rail with a laterally projecting tongue and extruding a door handle retainer member having a longitudinal channel with a shoulder opposite a laterally projecting groove. The method further comprises the steps of attaching the retainer member to a refrigerator door panel, inserting the rail of the door handle into the channel of the retainer member, moving the door handle laterally to slide the tongue of the door handle into the groove of the retainer member, and inserting a stop member into a gap between the rail and the shoulder of the channel to secure the door handle to the retainer member by preventing lateral removal of the tongue from the groove.

With such arrangement and method, the grip portion of the handle can be extruded into a variety of different cross sectional shapes an sizes, even shapes that completely cover over the mounting portion of the handle. This advantage is made possible because there is no need to position a screw driver past the grip portion to drive screws through the mounting portion to mount the handle. Rather, a retainer member is attached such as by screwing to the door panel when the handle and its grip portion are not present. Therefore, it is convenient to quickly drive screws directly into the retainer member during mounting. Then, the handle is readily mounted to the retainer member without the use of screws driven perpendicularly into the door panel. Therefore, the mounting does not impose any shape limitations on the handle, and handles can be extruded to provide product differentiation. In particular, the handle is attached to the retainer member merely by inserting the rail into the channel of the retainer member, and then moving the handle laterally to engage the tongues into the respective grooves. The final step is to insert stops such as screws into the gap between the rail and the opposite shoulder of the channel to prevent the tongues and grooves from becoming disengaged by lateral movement of the handle. A high quality refrigerator door is fabricated with relatively small labor costs.

BRIEF DESCRIPTION OF THE DRAWINGS

The foregoing objects and advantages will be more fully understood by reading the following Description of the Preferred Embodiment with reference to the Drawings wherein.

DESCRIPTION OF THE PREFERRED EMBODIMENT

Figure 1:
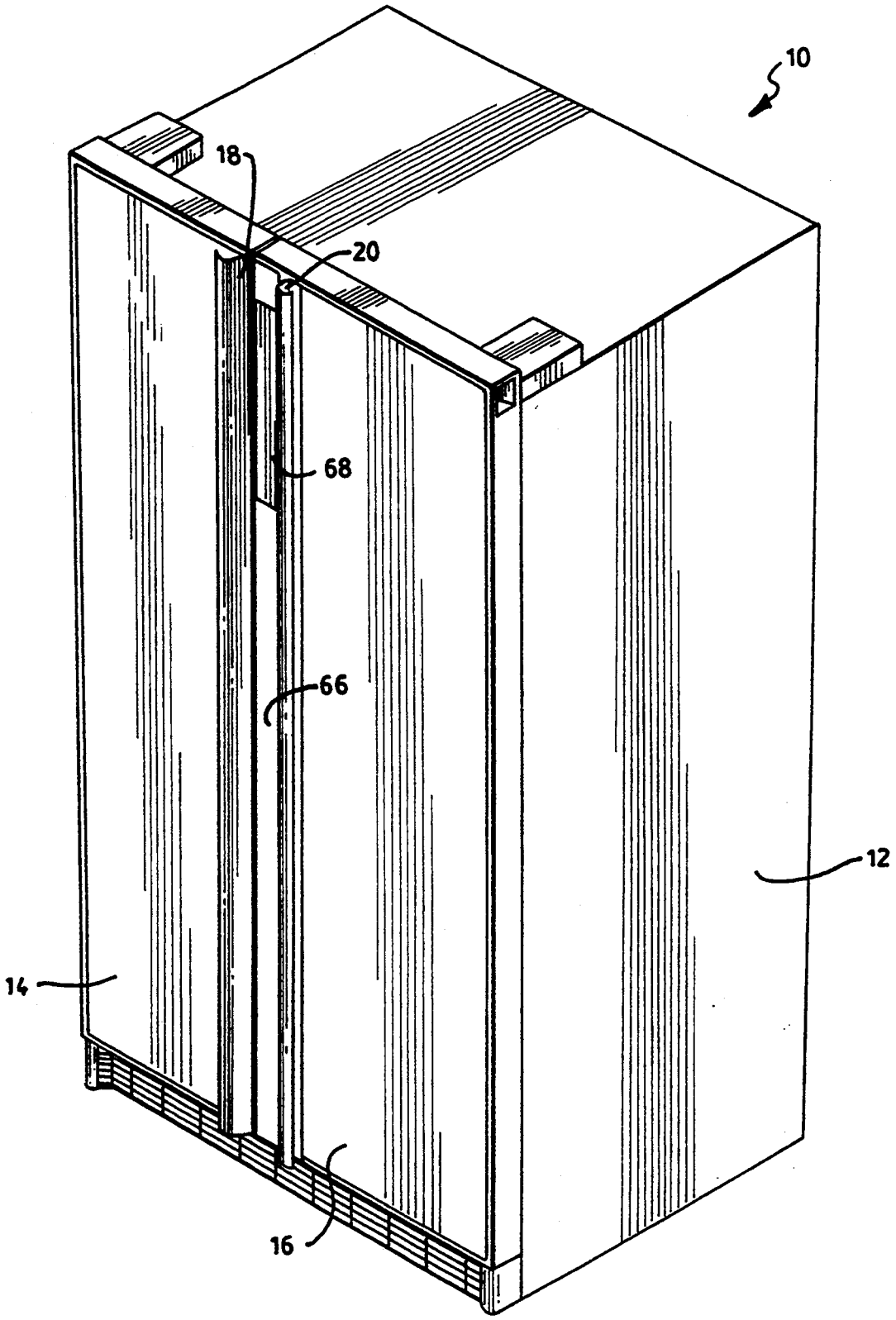
FIG. 1 is a front perspective view of a side-by-side refrigerator.
Figure 2B:
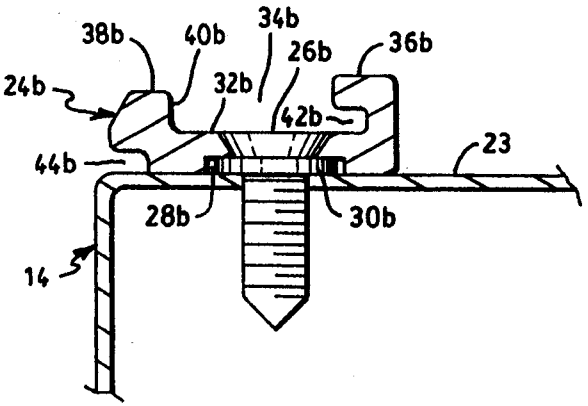
FIGS. 2B, 3B and 4B show sequential steps or stages in fabrication process of attaching a door handle to the freezer door of FIG. 1.
Figure 2A:
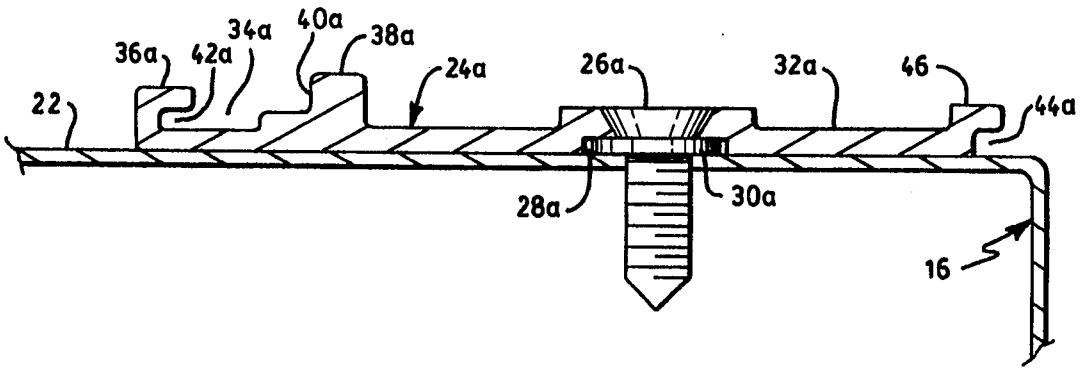
FIGS. 2A, 3A and 4A show sequential steps or stages in fabrication process of attaching a door handle to the refrigerator door of FIG. 1.

Referring to FIG. 1, a front perspective view of refrigerator 10 is shown. Although refrigerator 10 is here shown as a so-called side-by-side refrigerator, the invention can be used to advantage with other types of freezers and refrigerators such as so-called top mounts and bottom mounts. In fact, the invention can be used in a variety of other applications for attaching handles. Refrigerator 10 has an outer cabinet 12 or shell, and here has a left freezer door 14 that covers a freezer compartment (not shown) and a right refrigerator door 16 that covers a refrigerator compartment (not shown). Freezer door 14 and refrigerator door 16 have respective vertical door handles 18 and 20. Although shorter handles could be used, door handles 18 and 20 here span the entire vertical lengths of respective doors 14 and 16.

Referring to FIGS. 2A to 4A and 2B to 4B, sequential stages or steps in the fabrication process of doors 16 and 14 are shown. The top sectioned views show that door 16 has a front or face panel 22, and door 14 has a front or face panel 23. In the first steps of attaching door handles 18 and 20, retainer members 24*a* and *b* or strips serve as mounting brackets, and are attached to respective face panels 22 and 23. Here, retainer members 24*a* and *b* are attached by driving a plurality of screws 26*a* and *b* at various heights of respective doors 16 and 14 adjacent the edges where handles 20 and 18 are to be mounted. More specifically, each retainer member 24*a* and *b* or retainer is an extruded strip that here spans the vertical height of the respective doors 16 and 14, and each retainer member 24*a* and *b* has a plurality of screw holes 28*a* and *b* through which screws 26*a* and *b* are driven perpendicularly into respective panels 22 and 24 to securely attach retainer members 24*a* and *b* to respective doors 16 and 14. Screws 26*a* and *b* may be driven through gaskets 30*a* and *b*, respectively.

Door handle retainer members 24*a* and *b* each has a plate portion 32*a* and *b* that seats flush against respective panels 22 and 24. Further, each retainer member 24*a* and *b* has a vertical channel 34*a* and *b* formed by respective ridges 36*a* and *b* and 38*a* and *b*. As shown, ridges 38*a* and *b* have shoulders 40*a* and *b* opposite laterally projecting grooves 42*a* and *b*. Also, each retainer member 24*a* and *b* has a second groove 44*a* and *b*, respectively. With retainer member 24*b*, second groove 44*b* is formed in ridge 38*b*. However, with retainer member 24*a*, second groove 44*a* is formed in a second ridge 46 which is spaced from ridge 38*a*. The shapes of retainer members 24*a* and *b* are readily formed by extruding a metal such as aluminum through a suitable, relatively inexpensive die.

Figure 3B:
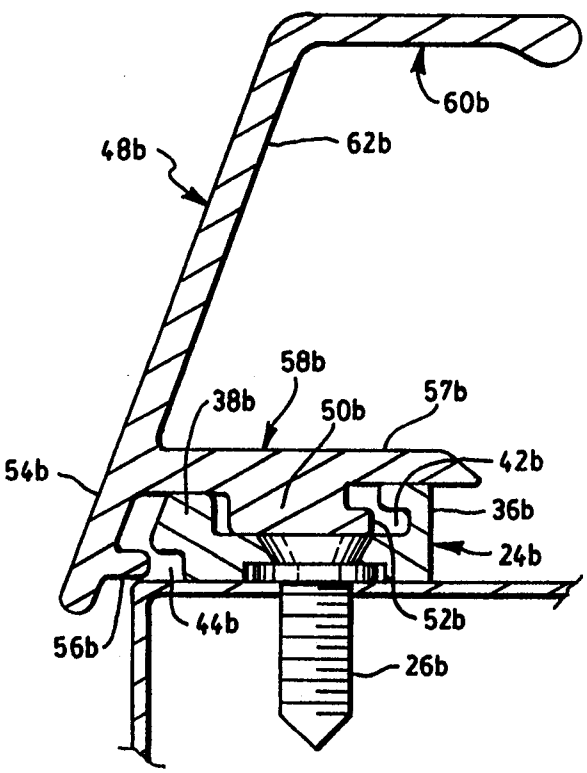
Figure 3A:
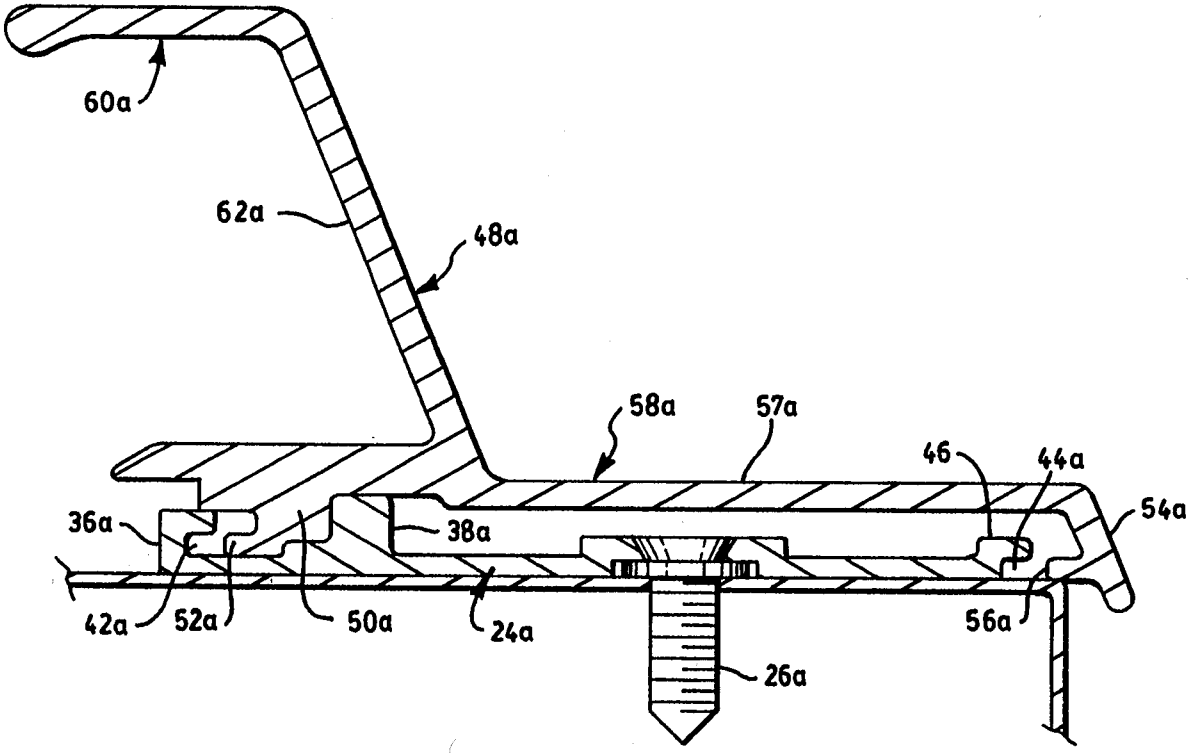

Referring to FIGS. 3A and 3B, the next step in fabricating respective doors 14 and 16 is to position respective handle members 48*a* and *b* such that rearwardly extending protrusions 50*a* and *b* insert into respective channels 34*a* and *b*. In particular, each protrusion 50*a* and *b* or rail has a laterally projecting tongue 52*a* and *b* that faces and aligns with respective grooves 42*a* and *b*. Further, each handle member 48*a* and *b* has a second rearward protrusion 54*a* and *b* with a laterally projecting tongue 56*a* and *b* that faces and aligns with second grooves 44*a* and *b*. Protrusions 50*a* and *b* and 54*a* and *b* along with respective cross members 57*a* and *b* form mounting portions 58*a* and *b* of respective handle members 48*a* and *b*. Handle members 48*a* and *b* also include respective grip portions 60*a* and *b* that are spaced from mounting portions 58*a* and *b* by respective legs 62*a* and *b*. As can be seen, grip portions 60*a* and *b* are substantially parallel to mounting portions 58*a* and *b*. Grip portion 60*b* substantially covers mounting portion 58*b*.

Figure 4B:
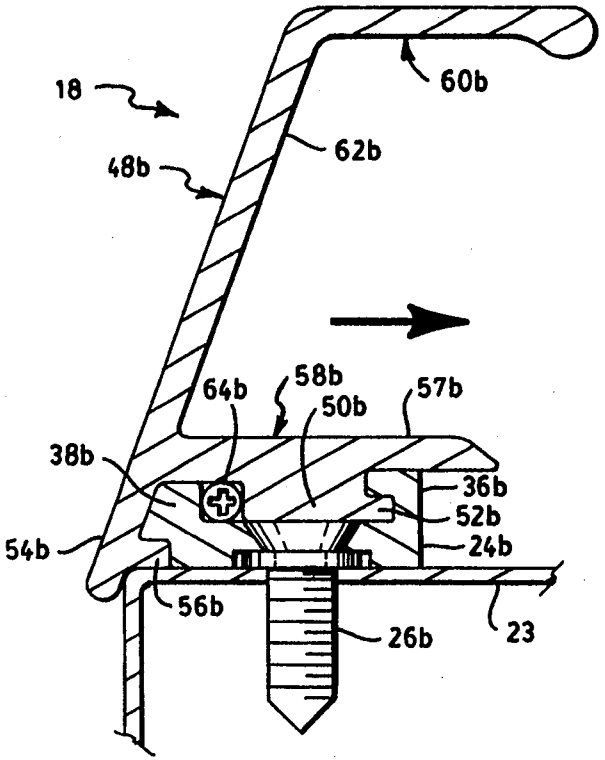
Figure 4A:
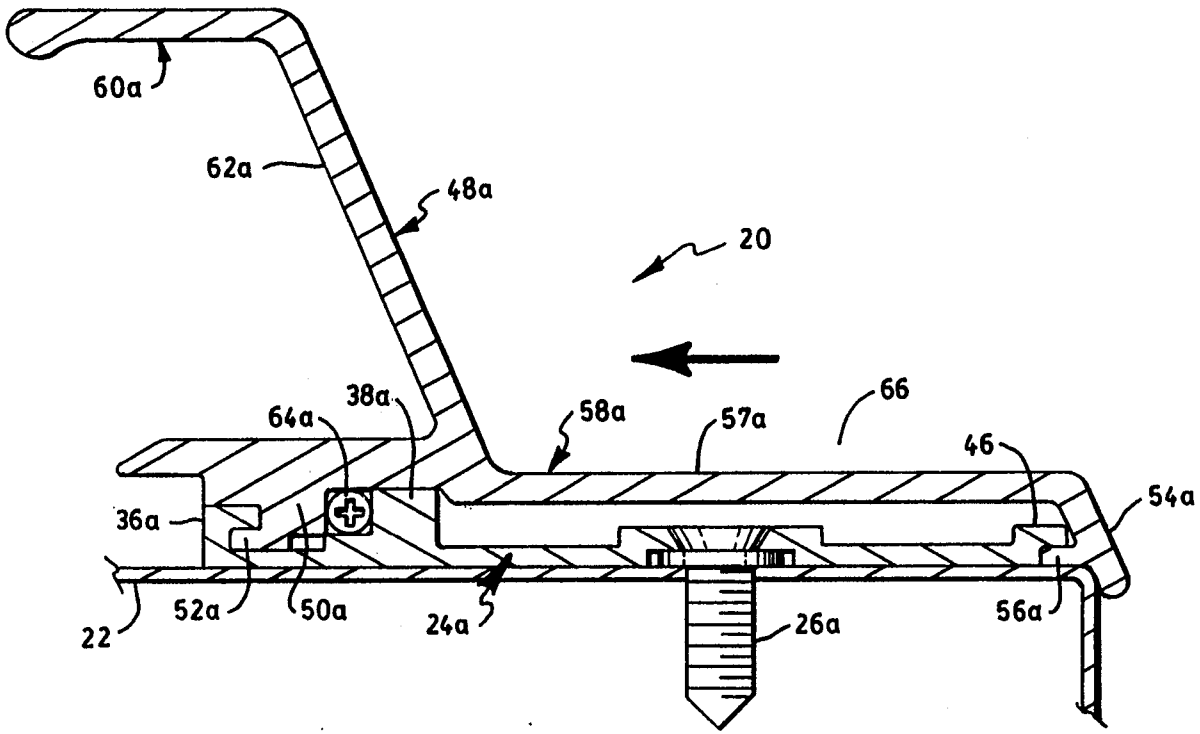

Referring to FIGS. 4A and 4B, handle members 48*a* and *b* are moved laterally to engage respective tongues 52*a* and *b* and 56*a* and *b* in grooves 42*a* and *b* and 44*a* and *b*. More specifically, the respective tongues 52*a* and *b* and 56*a* and *b* are shaped and sized to be received in sliding engagement into respective grooves 42*a* and *b* and 44*a* and *b*. In the arrangement shown in FIGS. 4A and 4B, handle members 48*a* and *b* are securely engaged to retainer members 24*a* and *b*. In accordance with the invention, stop members 64*a* and *b* are inserted between respective shoulders 40*a* and *b* and protrusions 50*a* and *b* to lock handle members 48*a* and *b* in these secured positions. In particular, stop members 64*a* and *b* prevent protrusions 50*a* and *b* from moving laterally thereby removing respective tongues 52*a* and *b* and 56*a* and *b* from grooves 42*a* and *b* and 44*a* and *b*. As an example, stop members 64*a* and *b* may be screws driven from the top and bottom into gaps formed between shoulders 40*a* and *b* and protrusions 50*a* and *b* as handle members 48*a* and *b* are slid laterally to engage handle members 48*a* and *b* to respective retainer members 24*a* and *b*.

As can be seen, handles 18 and 20 are attached to respective doors 14 and 16 in the same manner. That is, each has a tongue and groove arrangement that is engaged by relative lateral motion of a handle member to a retainer member, which engagement is then locked or secured by inserting stops such as screws from the ends to prevent removal of the tongue. The difference between the two handles 18 and 20 is that plate 57*a* of handle member 48*a* extends a greater distance than corresponding plate 57*b* to provide an area 66 where a control panel 68 can be located such as for an electronic controller as shown in FIG. 1. Without the use of a control panel 68 in area 66, it may be preferable that handle 20 be a mirror image of handle 18.

In accordance with the invention, certain restrictions on the shapes of handles 18 and 20 are eliminated. For example, handle member 48*b* can be extruded so that grip portion 60*b* completely covers mounting portion 58*b* as shown best in FIG. 4B. If handle 18 were a unitary part such as made by extruding or molding, it would be inconvenient if not impossible to position a screw driver to drive screws into the mounting portion 58*b* as shown. Here, however, the screw attaching operation is done on retainer member 24*b* when the handle member 48*b* is not present. Therefore, screws 26*b* can quickly and readily be driven perpendicularly through retainer member 24*b* into panel 23. Then, after retainer member 24*b* is securely attached to panel 23 with a minimum of labor, handle member 48*b* is readily attached to the retainer member 24*b*. This step also requires very little labor. Further, no separate trim strip is required to cover screws, and no associated labor costs are incurred. In review, rearward protrusion 50*b* or rail is inserted into channel 34*b*, and then handle member 48*b* is pushed laterally to slidably engage tongues 52*b* and 54*b* in respective grooves 42*b* and 44*b*. The only other labor step is to drive screws 64*b* into gaps at the top and bottom of handle 18. As a result, extruded handles can be made in a variety of different shapes to achieve product differentiation, and the door can be fabricated with a minimum of labor.

This concludes the description of the preferred embodiment. A reading of it by one skilled in the art will bring to mind many alterations and modifications that do not depart from the spirit and scope of the invention. For example, even though the tongues 52*a* and *b* and 56*a* and *b* were here shown in the handle members 48*a* and *b*, and the grooves 42*a* and *b* and 44*a* and *b* were here shown in retainer members 24*a* and *b*, the tongues and grooves could be reversed. Further, there are other structures that can engage by lateral motion, and then lock by inserting stops such as screws. Therefore, it is intended that the scope of the invention be limited only by the appended claims.

What is claimed is:

1. In combination:

a door;

a door handle retainer attached to said door;

a door handle;

said door handle and door handle retainer comprising respective engaging means responsive to relative lateral motion of said door handle to said door handle retainer for engaging said door handle to said door handle retainer wherein said engaging means comprises first and second tongues on said door handle and respective first and second mating grooves in said door handle retainer; and stop means for preventing relative lateral motion of said door handle once engaged to said door handle retainer to lock said door handle to said door handle retainer.

2. The combination recited in claim 1 wherein said door handle retainer comprises a channel having a shoulder opposite a laterally extending groove, and said door handle comprises a rearwardly projecting rail with a laterally projecting tongue adapted for sliding engagement into said groove of said door handle retainer.

3. In combination:

a door;

a door handle retainer attached to said door;

a door handle;

said door handle and door handle retainer comprising respective means responsive to relative lateral motion of said door handle to said door handle retainer for engaging said door handle to said door handle retainer;

stop means for preventing relative lateral motion of said door handle once engaged to said door handle retainer to lock said door handle to said door handle retainer;

said door handle retainer comprising a channel having a shoulder opposite a laterally extending groove, and said door handle comprising a rearwardly projecting rail with a laterally projecting tongue adapted for sliding engagement into said groove of said door handle retainer; and said stop means comprising a screw driven into a gap between said shoulder and said rail once said door handle is engaged to said door handle retainer.

4. A refrigerator door comprising:

a face panel;

a door handle mounting bracket attached to said face panel, said mounting bracket having a vertical channel with a laterally projecting groove opposite a shoulder;

a door handle having a vertical rail extending into said channel, said rail having a laterally projecting tongue received by lateral sliding engagement into said groove; and locking means disposed between said rail and said shoulder for securely locking said handle to said mounting bracket by preventing said tongue from sliding laterally out of said groove.

5. The door recited in claim 4 wherein said mounting bracket further comprises a second groove and said handle further comprises a second tongue received by lateral sliding engagement into said second groove.

6. The door recited in claim 4 wherein said locking means comprises a screw driven in between said rail and said shoulder.

7. The door recited in claim 4 wherein said mounting bracket and said handle are extruded parts.

8. A method of attaching a handle to a panel, comprising the steps of:

attaching a handle retainer to the door;

moving a handle laterally with respect to the door handle retainer to engage the handle to the handle retainer wherein the moving step comprises a step of slidably inserting a tongue on a handle protrusion into a groove laterally disposed in a channel of the handle retainer; and inserting a stop to prevent lateral movement of the handle with respect to the handle retainer once engaged to lock the handle to the handle retainer wherein the stop inserting step comprises a step of driving a screw into a gap between the handle protrusion and a shoulder of the channel of the handle retainer to prevent removal of the tongue from the groove.

9. A method of attaching a handle to a panel, comprising the steps of:

attaching to the panel a handle retainer having a longitudinal channel with a transversely projecting groove opposite a shoulder;

inserting a longitudinal protrusion of a handle into the channel;

moving the handle transversely to slidably engage a tongue on the protrusion into the groove of the channel; and inserting a stop longitudinally into a gap between the handle protrusion and the shoulder of the channel to secure the handle to the handle retainer by preventing the tongue from sliding transversely out of the groove.

10. The method recited in claim 9 wherein the handle retainer has a second groove and the handle protrusion has a second tongue, and the moving step further comprises a step of sliding the second tongue into the second groove.

11. The method recited in claim 9 wherein the attaching step comprises the step of screwing the handle retainer to the panel.

12. A method of fabricating a refrigerator door, comprising the steps of:

extruding a door handle having a rearwardly projecting rail with laterally projecting tongue;

extruding a door handle retainer member having a longitudinal channel with a shoulder opposite a laterally projecting groove;

attaching the retainer member to a refrigerator door panel;

inserting the rail of the door handle into the channel of the retainer member;

moving the door handle laterally to slide the tongue of the door handle into the groove of the retainer member; and inserting a stop member into a gap between the rail and the shoulder of the channel to secure the door handle to the retainer member by preventing lateral removal of the tongue from the groove.

13. The method recited in claim 12 wherein the handle retainer member has a second laterally projecting groove and the door handle has a second laterally projecting tongue, and the moving step further comprises a step of slidably engaging the second tongue of the door handle in the second groove of the door handle retainer.

14. The method recited in claim 13 wherein the stop inserting step comprises a step of driving a screw into a gap between the rail and a shoulder of the channel.

* * * * *